US010993880B2

(12) United States Patent
Evans

(10) Patent No.: US 10,993,880 B2
(45) Date of Patent: May 4, 2021

(54) PILL CRUSHER

(71) Applicant: Ann Evans, Stow, OH (US)

(72) Inventor: Ann Evans, Stow, OH (US)

( * ) Notice: Subject to any disclaimer, the term of this patent is extended or adjusted under 35 U.S.C. 154(b) by 204 days.

(21) Appl. No.: 16/295,020

(22) Filed: Mar. 7, 2019

(65) Prior Publication Data

US 2019/0201291 A1 Jul. 4, 2019

Related U.S. Application Data

(63) Continuation-in-part of application No. 15/793,113, filed on Oct. 25, 2017, now Pat. No. 10,548,813, which is a continuation-in-part of application No. 15/133,615, filed on Apr. 20, 2016, now Pat. No. 9,827,166.

(60) Provisional application No. 62/151,144, filed on Apr. 22, 2015.

(51) Int. Cl.
*A61J 7/00* (2006.01)

(52) U.S. Cl.
CPC ..... *A61J 7/0007* (2013.01); *A61J 7/0023* (2013.01)

(58) Field of Classification Search
CPC ..... A61J 7/0007; A61J 7/0015; A61J 7/0023; A61J 1/1418; B02C 19/00; B02C 19/08
USPC ..... 241/30, DIG. 27
See application file for complete search history.

(56) References Cited

U.S. PATENT DOCUMENTS 353,055 A * 11/1886 Dorr ..... G01F 19/00 73/427
662,588 A * 11/1900 Bloom ..... G01F 19/00 73/427
1,106,809 A * 8/1914 Haverty ..... A47G 21/04 30/327
2,485,303 A * 10/1949 Marcus ..... B65D 51/246 366/247
2,602,596 A * 7/1952 Jones ..... A61J 7/0007 241/169.1
2,795,043 A * 6/1957 Fleischer ..... A61J 7/0046 30/123.3
3,428,099 A * 2/1969 Tenenouser ..... B65D 41/26 141/380
3,618,751 A * 11/1971 Rich ..... B65D 75/54 206/219
3,931,741 A * 1/1976 Ceccarelli ..... G01F 19/002 73/427
4,209,136 A * 6/1980 Linden ..... A61J 7/0007 241/169.2

(Continued)

FOREIGN PATENT DOCUMENTS

DE 3209691 A1 * 9/1983 ..... A61J 7/0007
DE 19706341 A1 * 5/1998 ..... B02C 19/08

*Primary Examiner* — Shelley M Self
*Assistant Examiner* — Teresa A Guthrie
(74) *Attorney, Agent, or Firm* — Kevin Keener; Stephen Presutti

(57) ABSTRACT

A pill crushing device pulverizes pills and then transfers the pulverized pills out of the device with minimal transfer loss and spillage. The device includes a pill chamber. The pill chamber may form a threaded connection with the storage portion that enables detachment. The pill is pulverized in the pill chamber. A first spoon may retains the pill and carries the pulverized pill out of the chamber along a longitudinal opening of the pill chamber. An optional second spoon detachably attaches to the first spoon to carry supplemental compositions to the pulverized pill.

14 Claims, 13 Drawing Sheets

(56) References Cited

U.S. PATENT DOCUMENTS 4,366,930 A * 1/1983 Trombetti, Jr. ..... A61J 7/0007 241/169
4,765,549 A * 8/1988 Sherman ..... A61J 7/0007 241/169
4,830,222 A * 5/1989 Read ..... A47G 21/004 222/106
4,888,188 A * 12/1989 Castner, Sr. ..... A47G 19/183 426/109
4,967,971 A * 11/1990 Smith ..... A61J 7/0007 241/169
D337,828 S * 7/1993 Gordon ..... D24/220
5,322,227 A * 6/1994 Fiocchi ..... A61J 7/0007 241/100
5,533,683 A * 7/1996 Fay ..... B02C 2/10 241/169
6,003,710 A * 12/1999 Huang ..... B65D 51/246 215/228
6,102,254 A * 8/2000 Ross ..... A61K 9/0056 222/192
D433,148 S * 10/2000 Dennis ..... D24/220
6,347,727 B1 2/2002 Diaz
6,371,324 B1 * 4/2002 Torniainen ..... B65D 51/246 206/541
6,508,424 B1 * 1/2003 Marshall ..... A61J 7/0007 241/169.1
6,604,646 B2 * 8/2003 Torniainen ..... B65D 51/246 206/541
6,637,683 B1 10/2003 (Lomax) Wilbur
6,974,056 B2 * 12/2005 Rea ..... G01F 19/002 222/460
7,032,632 B2 * 4/2006 Shingle ..... B65D 51/246 141/112
7,487,894 B2 * 2/2009 Zahn ..... A61J 1/067 222/107
7,735,763 B2 6/2010 Bell et al.
7,823,819 B1 * 11/2010 Marshall ..... A61J 7/0007 241/169.1
7,874,269 B2 * 1/2011 Dunn ..... A01K 13/00 119/600
7,886,999 B2 * 2/2011 Ruzycky ..... A47J 19/06 241/168
7,975,943 B1 7/2011 Culves
8,033,488 B2 * 10/2011 Grah ..... A61J 7/0007 241/169.1
8,162,247 B2 * 4/2012 Faulker ..... B02C 19/08 241/169.2
D702,853 S 4/2014 Priebe et al.
8,720,807 B2 5/2014 Priebe et al.
8,720,808 B2 5/2014 Young et al.
9,010,669 B2 4/2015 Priebe et al.
9,827,166 B2 11/2017 Evans
D809,153 S 1/2018 Noble
9,925,542 B2 3/2018 Dow et al.
2009/0224088 A1 * 9/2009 Ruzycky ..... A47J 19/06 241/169.1
2014/0217209 A1 8/2014 Priebe et al.
2014/0217221 A1 8/2014 Hohl et al.

* cited by examiner

SECTION A-A

PILL CRUSHER

CROSS REFERENCE TO RELATED APPLICATIONS

This application is a continuation in part of U.S. patent application Ser. No. 15/793,113, filed Oct. 25, 2017, which is a continuation in part of U.S. patent application Ser. No. 15/133,615, filed Apr. 20, 2016, which claims the benefit of U.S. Provisional Application No. 62/151,144, filed Apr. 22, 2015, each of which is hereby incorporated by reference in its entirety.

BACKGROUND

The present subject matter relates generally to a pill crushing device for pulverizing pills and minimizing transfer loss and spillage of the pulverized pills.

SUMMARY

A pill crushing device pulverizes pills and then transfers the pulverized pills out of the device with minimal transfer loss and spillage. The device includes a pill chamber. The pill chamber may form a threaded connection with the storage portion that enables detachment. The pill is pulverized in the pill chamber. A first spoon may retains the pill and carries the pulverized pill out of the chamber along a longitudinal opening of the pill chamber. An optional second spoon detachably attaches to the first spoon to carry supplemental compositions to the pulverized pill.

BRIEF DESCRIPTION OF THE DRAWINGS

The subject matter will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear,"

Figure 1A:
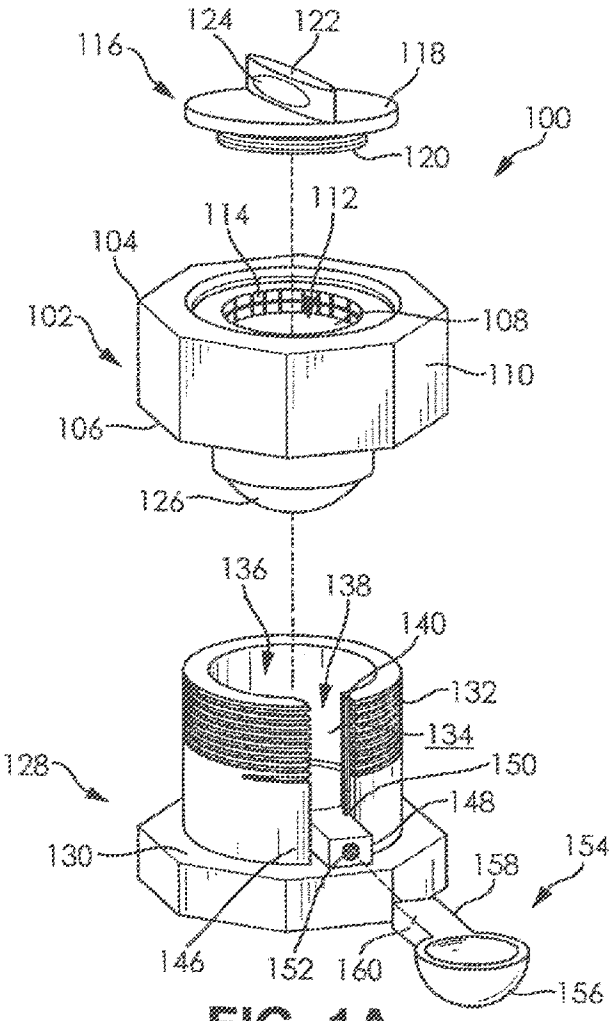
FIG. 1A illustrates a perspective frontal view of an exemplary pill crushing device, in accordance with an embodiment of the present subject matter.
Figure 1:
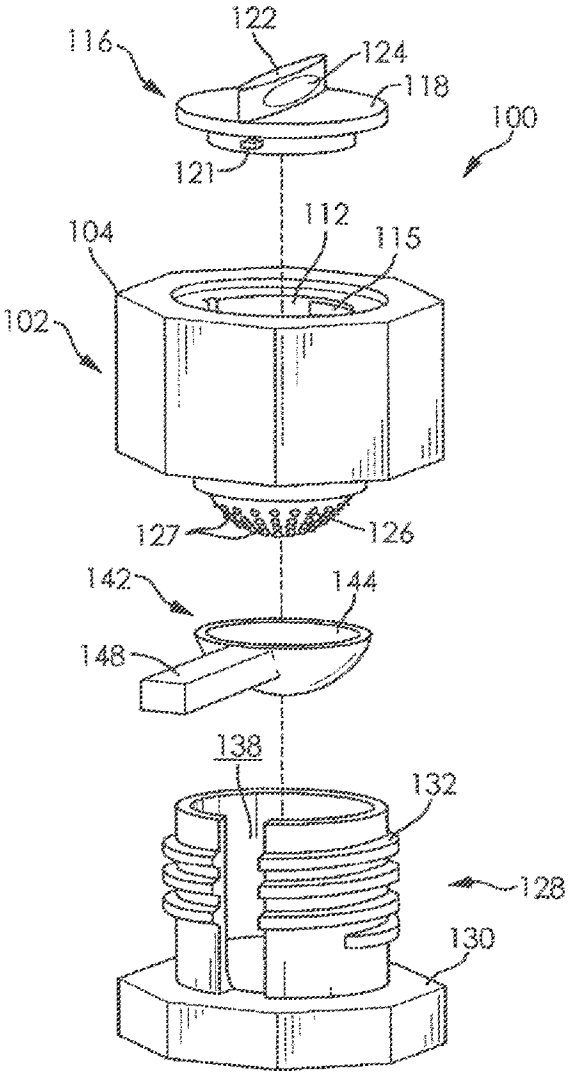
FIG. 1 illustrates a perspective frontal view of an exemplary pill crushing device, in accordance with an embodiment of the present subject matter.

"right," "front," "vertical," "horizontal," and derivatives thereof shall relate to the orientation shown in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this subject matter as required by 35 U.S.C. § 112.

In one embodiment of the present subject matter presented in FIGS. 1-11C, a pill crushing device 100 provides a multi-purpose medicinal administration tool that is efficacious for facilitating the preparation and administration of pills with minimal transfer loss and spillage. The pill crushing device 100, hereafter "device 100", provides a hand operated pill crusher that pulverizes a pill, and then transfers the pulverized pill for administration with minimal transfer loss or spillage.

As referenced in FIG. 1, device 100 comprises a storage portion 102 and a generally C-shaped pill chamber 128. Storage portion 102 is arranged to detachably attach to pill chamber 128. Pill chamber 128 forms a threaded connection with storage portion 102 that enables detachment and also creates the rotatable pulverizing means for device 100. Storage portion 102 is generally used to store the pill and actuate the crushing mechanism. Pill chamber 128 is generally where the pill is crushed. Thus, pill chamber 128 is disposed beneath storage portion 102, such that applied rotatable pressure and weight is maximized. Embodiments of the pill crushing device 100 that lack a storage portion are also envisioned as part of the invention. In such case, storage portion 102 and lid 116 are replaced by a single piece crusher 201.

Figure 2A:
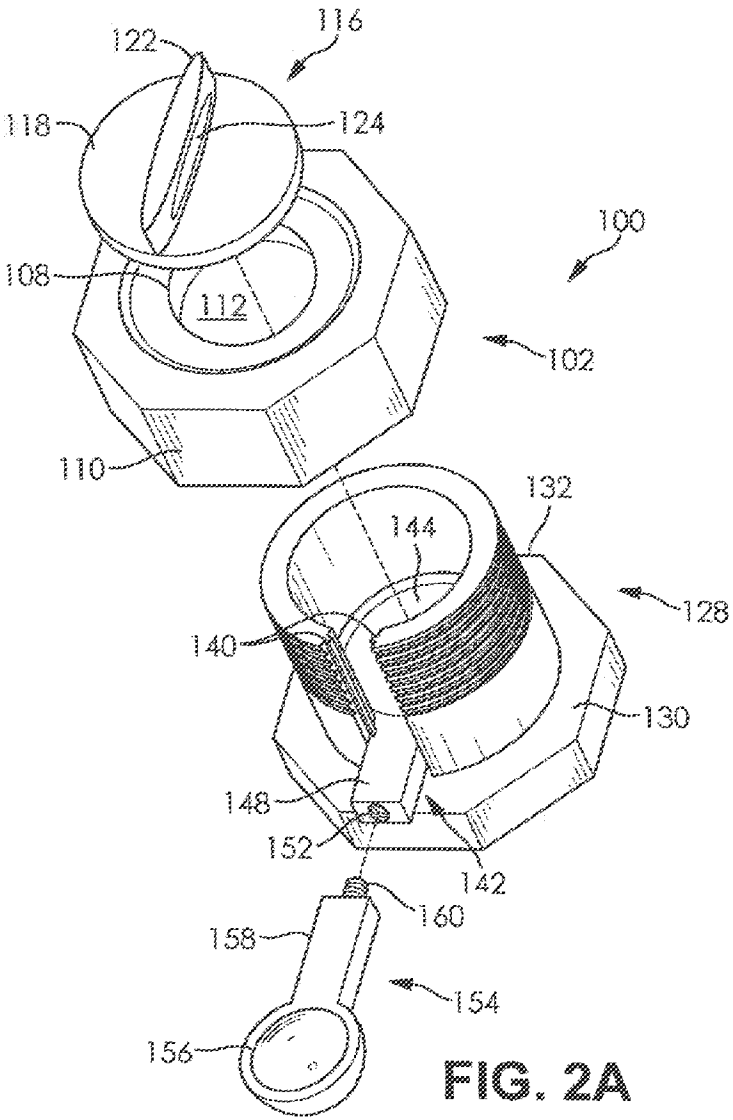
FIG. 2A illustrates a perspective top angle view of the pill crushing device, in accordance with an embodiment of the present subject matter.
Figure 2:
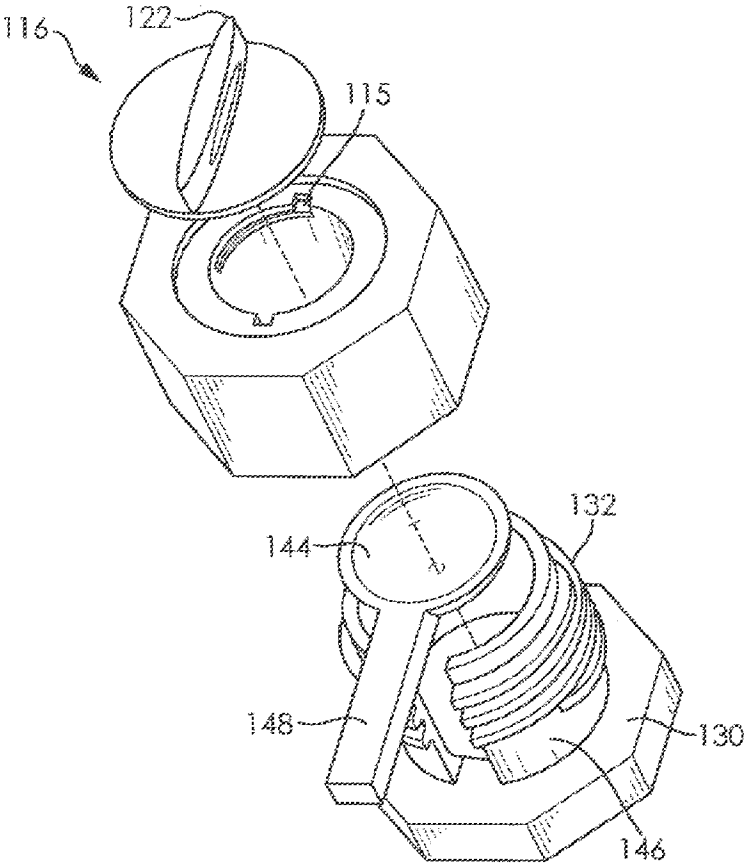
FIG. 2 illustrates a perspective top angle view of the pill crushing device, in accordance with an embodiment of the present subject matter.
Figure 3A:
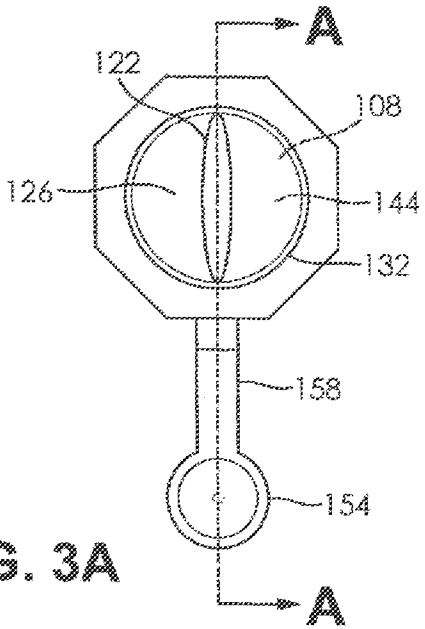
FIG. 3A illustrates a sectioned top view of the pill crushing device.
Figure 3:
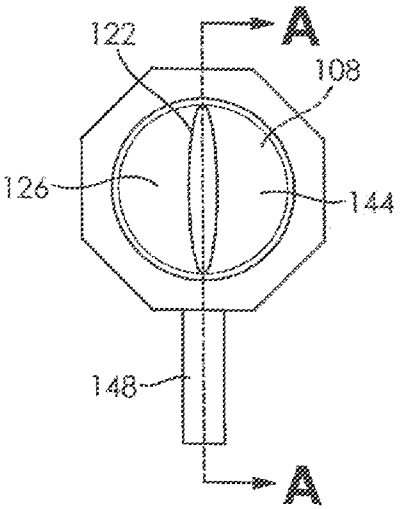
FIG. 3 illustrates a sectioned top view of the pill crushing device.

Turning now to FIGS. 1, 1A, 2 and 2A, a first spoon 142 in pill chamber 128 retains the pills and steadily carries the pulverized pill out of the chamber along a longitudinal opening 138 in the peripheral sidewalls of the pill chamber 128. In FIGS. 1A and 2A a second spoon 154 detachably attaches to first spoon 142 to carry and add supplemental compositions to the pulverized pills in the first spoon 142.

Figure 10A:
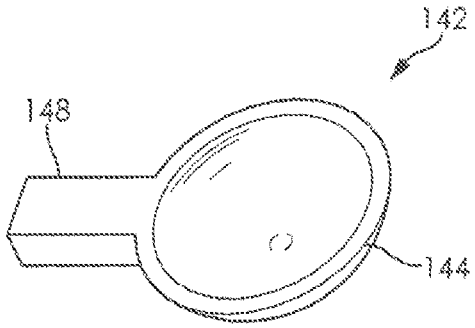
FIG. 10A illustrates a perspective view of a second embodiment of a first spoon.
Figure 10B:
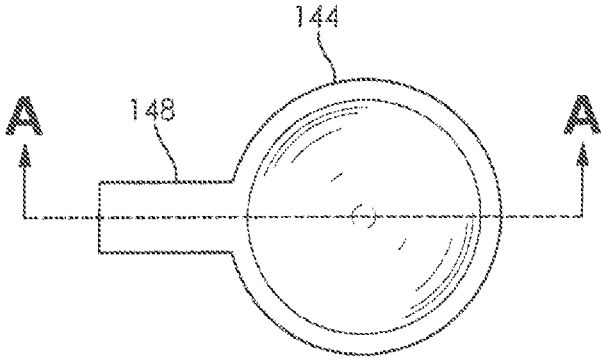
FIG. 10B illustrates a sectioned side view of the second embodiment of the first spoon.
Figure 10C:
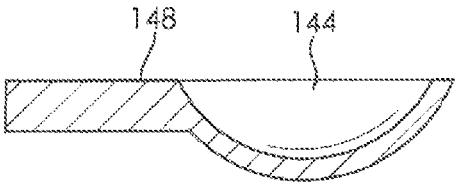
FIG. 10C illustrates the section taken along section A-A of FIG. 10B, detailing the second embodiment of the first spoon, in accordance with an embodiment of the present subject matter.

First spoon 142 serves to retain the pill in pill chamber 128 while pulverizing the pills. First spoon 142 is also configured to steadily ride along a longitudinal opening 138 in pill chamber 128 to carry the crushed pills out of pill chamber 128 with minimal transfer loss and spillage. Lateral and oscillating motions are minimized due to a snug tongue 140 and slot 150 relationship between first spoon 142 and longitudinal opening 138; and a brace 146 on the first spoon 142 that presses against an inner chamber sidewall 134 of pill chamber 128 during transfer. The pulverized pill may then be administered directly from first spoon 142. However as seen in FIGS. 10A-10C, the slot 150 is optional (and not present in these embodiments).

As shown in FIGS. 6A, and 11A-11C an optional second spoon 154 detachably attaches to first spoon 142, and works in conjunction with the first spoon 142 to enhance the crushed pill by carrying supplementary compositions and foods to be mixed with the pulverized pill. The supplementary compositions and foods may include, without limitation, apple sauce, honey, sugar, and spices as well as any food or liquid that can be taken together to make a medicine go down in a most delightful way. Optional second spoon 154 also serves to further elongate a first handle 148 of first spoon 142.

In one aspect, the pill crushing device 100 for pulverizing pills and minimizing transfer loss of pulverized pills comprises:

a storage portion 102, the storage portion 102 defined by a lid end 104, a pulverizing end 106, a threaded inner sidewall 108, an outer sidewall 110 (that is optionally textured), a threaded storage opening 114, and a storage cavity 112;

a lid 116, the lid 116 defined by a panel 118, a connector which may be slot-and-tab connector 115 or optionally threaded connector 120, and a lid handle 122. The lid handle 122 may, but need not, include a depression 124, or other feature to assist gripping of the handle 122.

The lid 116 attaches to the lid end 104 of the storage portion 102 by rotation of the tab connector 121 (or threaded connector 120) against slot opening 115 (or threaded storage opening 114) in a first direction, wherein the lid 116 detaches from the lid end 104 of the storage portion 102 by rotation of the tab connector 121 (or of the threaded connector 120) against slot opening 115 (or threaded storage opening 114) in a second direction;

a crushing member 126, the crushing member 126 disposed to protrude from the pulverizing end 106 of the storage portion 102;

a generally C-shaped pill chamber 128, the pill chamber 128 defined by a platform 130, a threaded outer chamber sidewall 132, an inner chamber sidewall 134, a pill cavity 136, and a longitudinal opening 138, the longitudinal opening 138 optionally comprising a tongue 140, wherein the crushing member 126 is displaced into the pill cavity 136 of the pill chamber 128 by rotation of the threaded inner sidewall 108 against the threaded outer chamber sidewall 132 in the first direction, wherein the crushing member 126 is displaced out of the pill cavity 136 by rotation of the threaded inner sidewall 108 against the threaded outer chamber sidewall 132 in the second direction;

a first spoon 142, the first spoon 142 configured to slidably move along the longitudinal opening 138 for detachment from the pill chamber 128, the first spoon 142 defined by a first head 144 and an elongate first handle 148, the first head 144 oriented generally towards the pill cavity 136, the first handle 148 oriented generally towards the outside of the chamber cavity, the first head 144 comprising a brace 146, the brace 146 configured to press against the inner chamber sidewall 134 of the pill chamber 128, the first handle 148 optionally comprising a pair of optional slots 150 and an optional first fastening junction 152 (to be used, for example, in conjunction with optional second spoon 154, noted hereinbelow), the pair of slots 150 configured to mate with the optional tongue 140 of the longitudinal opening 138, wherein the relationship between the brace 146 and the inner chamber sidewall 134 helps minimize lateral and oscillating motions by the first spoon 142 during movement along the longitudinal opening 138, wherein the relationship between optional the pair of slots 150 and the optional tongue 140 helps minimize lateral and oscillating motions by the first spoon 142 during movement along the longitudinal opening 138.

In an alternate embodiment, the pill crushing device 100 further comprises a second spoon 154, the second spoon 154 defined by a second head 156 and an elongate second handle 158, the second handle 158 terminating at a second fastening junction 160, the second fastening junction 160 configured to detachably couple to the first fastening junction 152 of the handle 148.

In a second aspect, the storage portion 102 has a generally octagonal shape in cross section. Other cross sectional shapes such as circular, triangular, square, pentagonal, hexagonal and various polygons are also envisioned (and not pictured).

In another aspect, when outer sidewall 110 is optionally textured, it is defined by a pattern of textures configured to enhance grip of the storage portion 102.

In another aspect, the pattern of textures are piano-key shaped gripping lines. Other texture patterns including dimples and indentations; cross hatching, cross drilling and a roughened surface such as sandpaper or other abrasive are envisioned. In some non-limiting embodiments, there are no textures and the gripping surfaces are smooth.

In another aspect, the lid 116 has a generally circular shape.

In another aspect, the crushing member 126 has a generally spherical shape, however parabolic or hyperbolic shapes are also envisioned. Crushing member 126 may optionally include at least one protrusion 127 to assist in crushing a tablet or pill.

In another aspect, the first spoon 142 is configured to receive a pill while in the pill cavity 136.

In another aspect, the first spoon 142 is configured to provide a base for the pill while the pill is pulverized by the crushing member 126.

In another aspect, the first spoon 142 is configured to administer the pill while detached from the pill chamber 128.

In another aspect, the optional second spoon 154 is configured to receive a supplemental composition or food for adding to the pulverized pill.

In another aspect, the platform 130 has a generally octagonal shape. Other shapes such as circular, square, hexagonal and various polygons are also envisioned (and not pictured). In another aspect, the platform 130 is defined by a pattern of textures (not shown) configured to enhance grip of the pill chamber 128.

In another aspect, the first fastening junction 152 is a threaded opening.

In another aspect, the second fastening junction 160 is a threaded protrusion, the threaded protrusion configured to rotatably couple to the threaded opening of the first handle 148.

One objective of the present subject matter is to provide a pill crushing device 100 that has a first spoon 142 for receiving a pill.

Another objective is to provide a first spoon 142 for supporting the pill while the pill is being pulverized.

Another objective is to provide a first spoon 142 for disengaging from the pill chamber 128 with minimal transfer loss or spillage.

Another objective is to provide a snug engagement between the brace 146 and the inner chamber sidewall 134 to minimize lateral and oscillating motions by the first spoon 142 during movement along the longitudinal opening 138.

Another objective optionally is to provide a snug engagement between the pair of optional slots 150 and the optional tongue 140 to minimize lateral and oscillating motions by the first spoon 142 during movement along the longitudinal opening 138.

Another objective is to provide a crushing member 126 that pulverizes the pill through a manual, rotatable mechanism.

Optionally, the subject matter provides a second spoon 154 that detachably attaches to the first spoon 142.

Optionally, the subject matter provides a second spoon 154 that may be used to transport a food or liquid to be consumed together with the pulverized pills.

Optionally, the subject matter provides piano shaped grips on the textured outer sidewall 110 of the storage portion 102 to enhance the grip when rotating the lid 116 against the storage portion 102. Other grip texture patterns including dimples and indentations; cross hatching, cross drilling and a roughened surface such as sandpaper or other abrasive are envisioned.

Optionally, the subject matter provides piano shaped grips on the platform 130 of the storage portion 102 to enhance the grip when rotating the storage portion 102 against the pill chamber 128. Other grip texture patterns including dimples and indentations; cross hatching, cross drilling and a roughened surface such as sandpaper or other abrasive are envisioned.

Another objective is to provide a pill crushing device 100 that is inexpensive to manufacture and easy to operate.

Another objective it a method of crushing a pill or tablet including operation of the device pill crushing device 100 by displacing the crushing member 126 into the pill cavity 136 of the pill chamber 128 by rotation of the threaded inner side wall 108 against the threaded outer chamber 132.

Figure 4A:
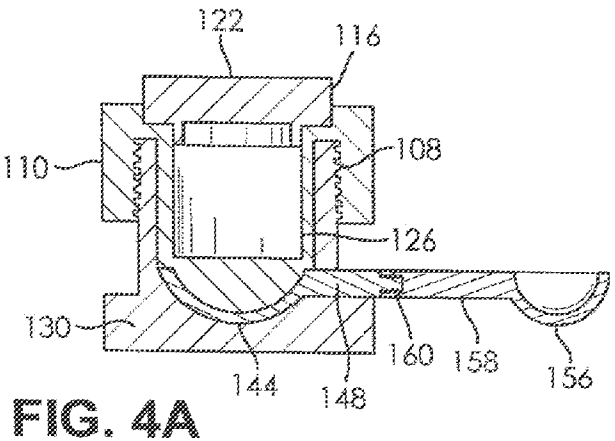
FIG. 4A illustrates the section taken along section A-A of FIG. 3A, detailing the pill crushing device, in accordance with an embodiment of the present subject matter.
Figure 4:
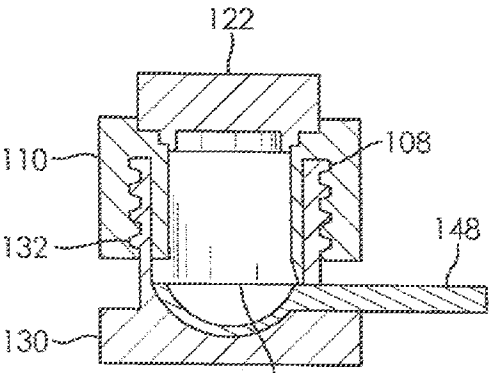
FIG. 4 illustrates the section taken along section A-A of FIG. 3, detailing the pill crushing device, in accordance with an embodiment of the present subject matter
Figure 5A:
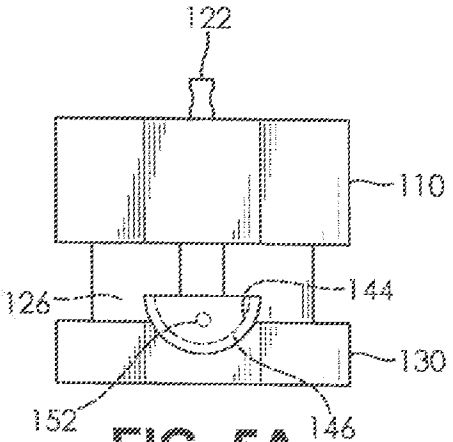
FIG. 5A illustrates a frontal view of the pill crushing device, in accordance with an embodiment of the present subject matter.
Figure 6A:
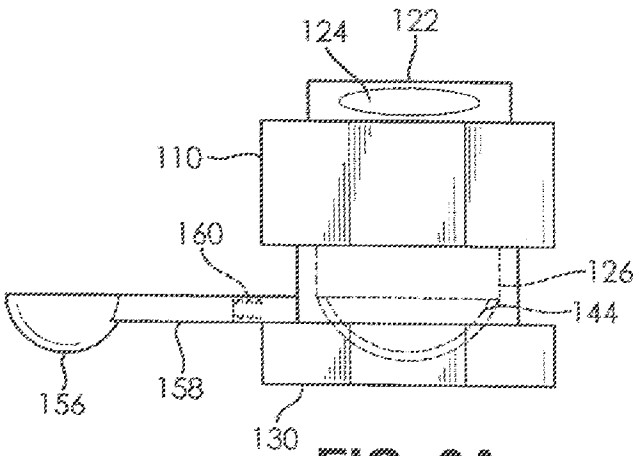
FIG. 6A illustrates an elevated side view of the pill crushing device, in accordance with an embodiment of the present subject matter.
Figure 5:
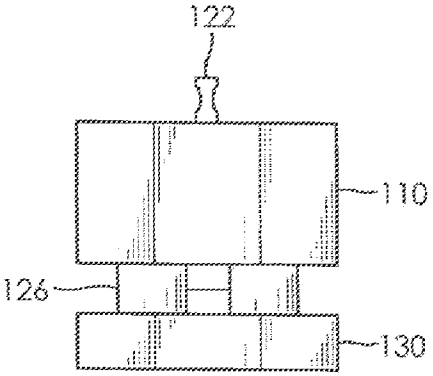
FIG. 5 illustrates a frontal view of the pill crushing device, in accordance with an embodiment of the present subject matter.
Figure 6:
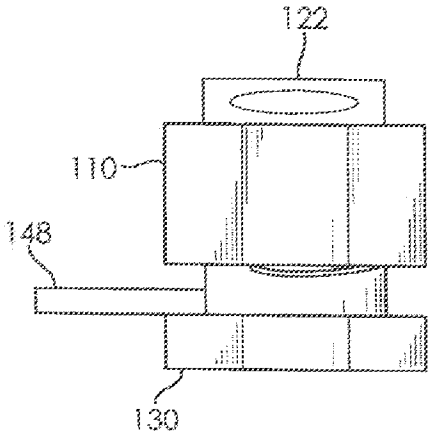
FIG. 6 illustrates an elevated side view of the pill crushing device, in accordance with an embodiment of the present subject matter.

As illustrated in the FIGURES, device 100 comprises a storage portion 102 and a generally C-shaped pill chamber 128. In one aspect, "C-shaped" can mean generally cylindrical with a longitudinal opening 138 cut out. Storage portion 102 is arranged to detachably attach to pill chamber 128. Pill chamber 128 forms a threaded connection with storage portion 102 that enables detachment and also creates the rotatable pulverizing means for device 100. Storage portion 102 is generally used to store the pill and actuate the crushing and pulverizing mechanism. Pill chamber 128 is generally where the pill is pulverized and stored until administered. Thus, pill chamber 128 is disposed beneath the storage portion 102, such that applied rotatable pressure is maximized (FIGS. 4 and 5). Suitable materials for storage portion 102 and pill chamber 128 may include, without limitation, a thermoplastic polymer, a rubber, polyurethane, polyvinyl chloride, a metal, glass, ceramic, and wood.

As shown in the FIGURES, storage portion 102 is defined by a lid end 104, a pulverizing end 106, a threaded inner sidewall 108, an outer sidewall 110 that is optionally textured, and a threaded storage opening 114. Storage portion 102 further includes a storage cavity 112 that is shaped and dimensioned to receive a pill. A detachably attached lid 116 on the lid end 104 of the storage portion 102 provides access to the storage cavity 112. The lid 116 comprises a panel 118, a threaded connector 120, and a lid handle 122 having a depression 124. The lid handle 122 extends from the panel 118 to enable rotational manipulation of the lid 116. Depression 124 is disposed in lid handle 122 to receive a digit, such as a thumb, for facilitating gripping of lid 116 while rotating and detaching lid 116.

Storage cavity 112 is accessed by rotatably removing lid 116 from lid end 104. In one embodiment, lid 116 attaches to lid end 104 of storage portion 102 by rotation of a tab connector 121 against slotted connecting channel 115. In this embodiment, conversely, lid 116 detaches from lid end 104 of storage portion 102 by rotation of a tab connector 121 against slotted connecting channel 115 in a second direction.

In another embodiment, lid 116 attaches to lid end 104 of storage portion 102 by rotation of threaded connector 120 against threaded storage opening 114 in a first direction. Conversely, lid 116 detaches from lid end 104 of storage portion 102 by rotation of threaded connector 120 against threaded storage opening 114 in a second direction. In the embodiment of this or the preceding paragraph, when lid 116 is detached, the pill may be removed from storage portion 102 for pulverizing. In one embodiment, lid 116 forms an air tight seal with the threaded storage opening 114 to maintain freshness of the pill.

Looking now at FIGS. 1-7D, storage portion 102 further includes a crushing member 126 that protrudes from pulverizing end 106 of the storage portion. Crushing member 126 forcibly and rotatably engages the pills during the pulverizing process. Crushing member 126 may take a generally spherical shape that maximizes surface area contact with the pill. Crushing member 126 may optionally include dimples 127 (best seen in FIG. 1) to increase pulverizing force. Outer sidewall 110 (optionally textured) of storage portion 102 enables rotation of storage portion 102 with minimal slippage.

Figure 8B:
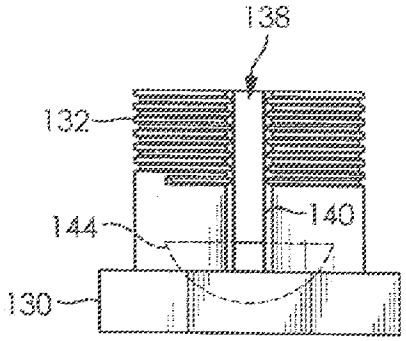
FIG. 8B illustrates an elevated side view of the pill chamber.
Figure 8D:
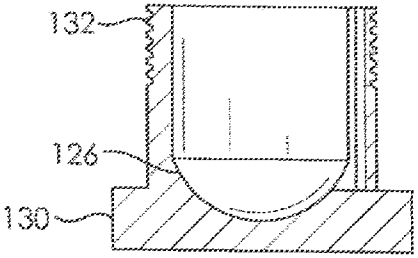
FIG. 8D illustrates the section taken along section A-A of FIG. 8C, detailing the pill chamber, in accordance with an embodiment of the present subject matter.
Figure 8A:
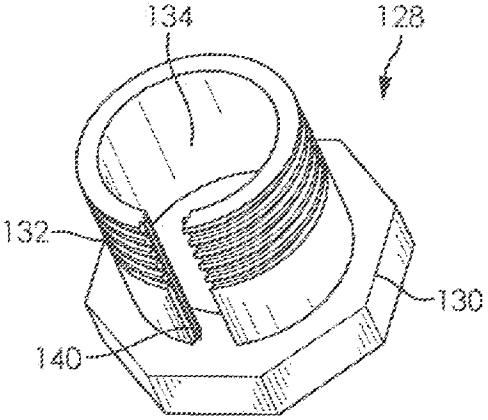
FIG. 8A illustrates a perspective view of a pill chamber.
Figure 8C:
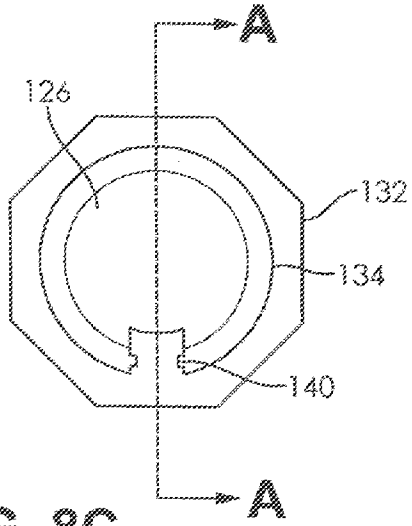
FIG. 8C illustrates a sectioned side view of the pill chamber.

As referenced in FIGS. 8A and 8B, device 100 further comprises a generally C-shaped pill chamber 128. Pill chamber 128 is defined by a platform 130, a threaded outer chamber sidewall 132, an inner chamber sidewall 134, a pill cavity 136, and a longitudinal opening 138. Platform 130 of pill chamber 128 supports the weight of device 100 while pulverizing the pill. The pill cavity 136 is chiefly where the pill is pulverized. The longitudinal opening 138 provides a path for carrying the crushed pills out of pill cavity 136, such that there is minimal loss of transfer or spillage of the crushed pills. The longitudinal opening 138 comprises an tongue 140 that extends along the length of the longitudinal opening 138 (FIG. 8B). Tongue 140 is configured to help maintain the stability during transfer. In certain embodiments, tongue 140 is absent.

Crushing member 126 rotates in relation to pill chamber 128 to pulverize the pill. In one embodiment, storage portion 102 is gripped at textured outer sidewall 110, and then rotated to thread into pill chamber 128 and to drive crushing member 126 into pill chamber 128 for crushing the pill. Thus, crushing member 126 is displaced into the pill cavity 136 of pill chamber 128 by rotation of threaded inner sidewall 108 against threaded outer chamber sidewall 132 in the first direction (FIG. 8D). In this disposition, the pill is pulverized by the force and weight of crushing member 126. Conversely, crushing member 126 is displaced out of pill cavity 136 by rotation of the threaded inner sidewall 108 against threaded outer chamber sidewall 132 in the second direction.

Referencing FIGS. 9A-9C and 10A-10C, device 100 may utilize a first spoon 142 to support the pulverizing means inside pill chamber 128. First spoon 142 may also carry the pulverized pill out of the pill chamber 128 in a steady disposition along longitudinal opening 138. First spoon 142 may also be used to administer the pulverized pill. First spoon 142 is defined by a first head 144 and an elongate first handle 148. First head 144 is oriented generally towards the chamber cavity, while elongate first handle 148, at least partially, extends out through longitudinal opening 138.

First head 144 provides both a surface for direct administration of the pulverized pill, and a supportive and removable base inside pill chamber 128. First head 144 is concave shaped so as to be adapted to receive the pill for crushing, and then feed the pulverized pill into a mouth. A brace 146 forms beneath first head 144. Brace 146 is configured to press against the inner chamber sidewall 134 of pill chamber 128 while slidably engaging the longitudinal opening 138 of pill chamber 128 so as to increase stability while first spoon 142 rides up and down longitudinal opening 138. In one embodiment, brace 146 forms a generally U-shape that contours the curved surface of inner chamber sidewall 134.

Figure 9A:
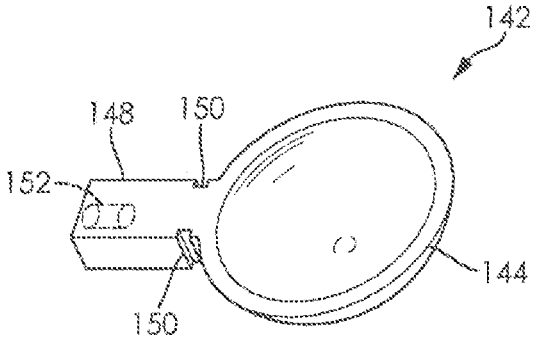
FIG. 9A illustrates a perspective view of a first spoon.
Figure 9B:
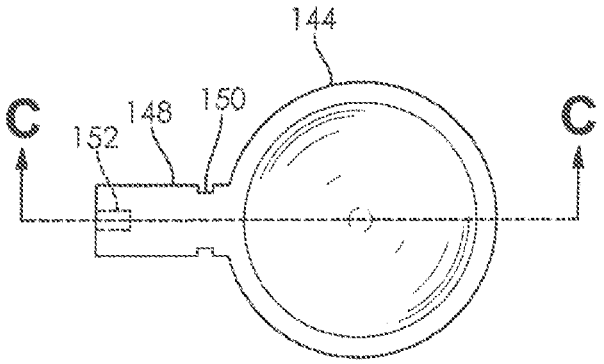
FIG. 9B illustrates a sectioned side view of the first spoon.

As shown in FIG. 9B, elongate first handle 148 extends generally perpendicular from longitudinal opening 138 of pill chamber 128. A pair of optional slots 150 form on opposite lateral sides of first handle 148. Optional slots 150 catch the optional tongue from longitudinal opening 138, forming a snug interaction therebetween. Because of the slidable interaction between optional tongue 140 and optional slots 150, the first handle slides up and down along the length of pill chamber 128 with minimal lateral sway or tilting. This relatively smooth slidable movement enables first spoon 142 to carry the pulverized pill out of the cavity with minimal transfer loss and spillage. Thus, the relationship between brace 146 and inner chamber sidewall 134, and also the pair of slots and the tongue helps minimize lateral and oscillating motions by first spoon 142 during movement along longitudinal opening 138.

Figure 9C:
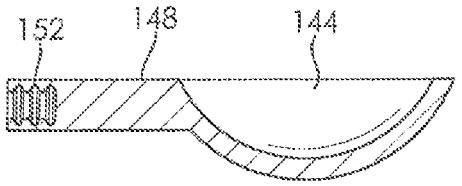
FIG. 9C illustrates the section taken along section A-A of FIG. 9B, detailing the first spoon, in accordance with an embodiment of the present subject matter.

As illustrated in FIG. 9C, first handle 148 may (but need not) terminate at a first fastening junction 152. Optional first fastening junction 152 may include a threaded opening. However, in other embodiments, optional first fastening junction 152 may be selected from a threaded protrusion, a magnet, a screw, and an adhesive.

FIGS. 10A-10C depict the embodiment of FIGS. 9A-9C lacking slots 150 and fastening junction 152.

Figure 11A:
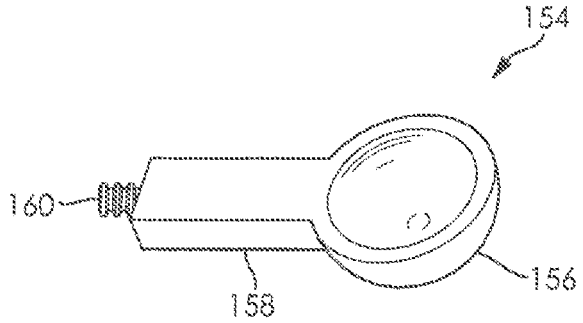
FIG. 11A illustrates a perspective view of an optional second spoon.

Turning now to FIG. 11A, device 100 optionally further comprises a second spoon 154 that detachably attaches to first spoon 142. It is noted that in some non-limiting embodiments, the subject matter does not include second spoon 154, though such is not excluded from the scope of the subject matter. Second spoon 154 is defined by a second head 156 having a generally concave shape, similar to the first head 144. However, in some embodiments, second head 156 is smaller than first head 144. Second head 156 is configured to receive and carry supplements, compositions, and/or food to add to the crushed pills.

Figure 11B:
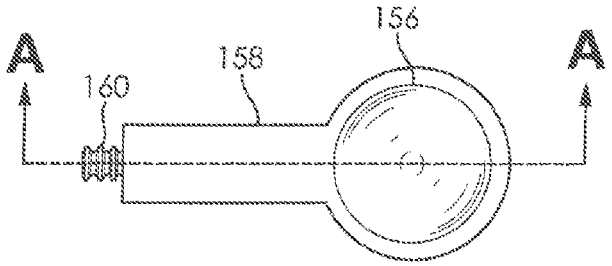
FIG. 11B illustrates a sectioned side view of the optional second spoon.
Figure 11C:
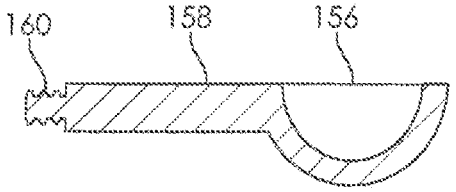
FIG. 11C illustrates the section taken along section A-A of FIG. 11B, detailing the optional second spoon, in accordance with an embodiment of the present subject matter.
Figure 12:
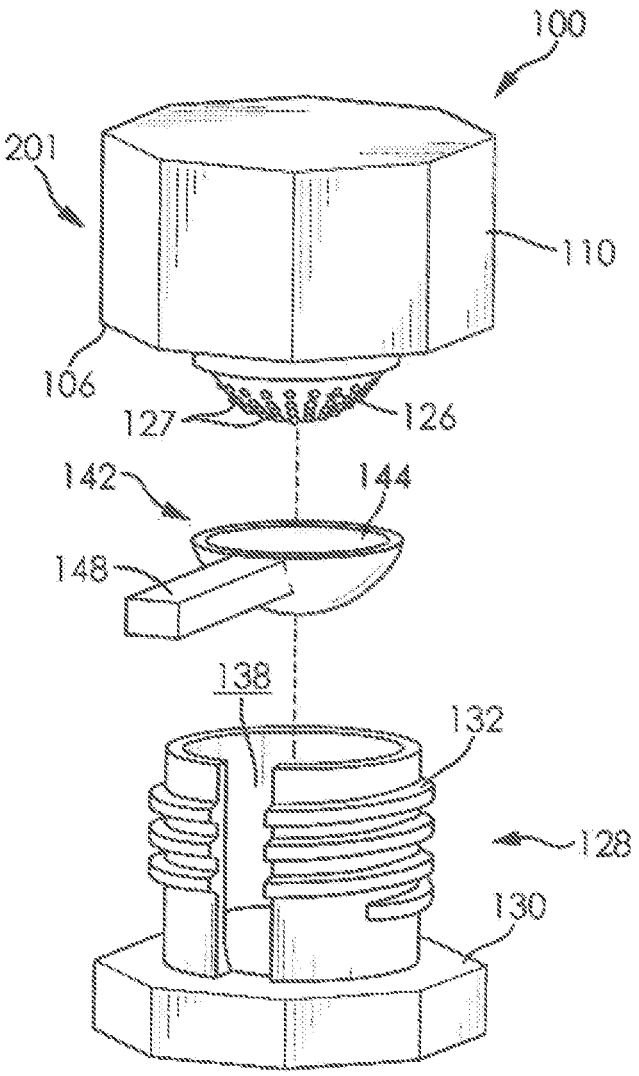
FIG. 12 illustrates a perspective frontal view of another exemplary pill crushing device, in accordance with an embodiment of the present subject matter.

As shown in FIGS. 11B and 11C, second head 156 further includes an elongate second handle 158. Second handle 158 terminates at a second fastening junction 160. Second fastening junction 160 is configured to couple to first fastening junction 152 of the first handle through a threaded protrusion, or other fastening means known in the art. In this manner, the first and second spoons 142, 154 detachably attach at their respective handles 148, 158.

In operation, the pill is stored in storage cavity 112 of storage portion 102. Lid 116 is rotatably removed by rotating lid handle 122 in the first direction. The threaded connector 120 on lid 116 rotatably engages threaded storage opening 114 of storage portion 102. Once lid 116 is removed, the pill is removed and transferred into pill cavity 136, resting on first head 144 of first spoon 142. Outer sidewall 110 of storage portion 102 is rotated in the first direction to displace crushing member 126 into the pill cavity 136 of pill chamber 128. The displacement of crushing member 126 is operable by rotation of threaded inner sidewall 108 of storage portion 102 against threaded outer chamber sidewall 132 of pill chamber 128 in the first direction. In this disposition, the pill is pulverized by the force and weight of crushing member 126.

Figure 7B:
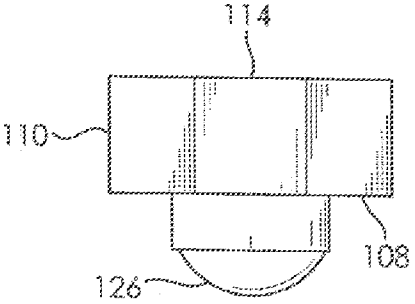
FIG. 7B illustrates an elevated side view of the storage portion and the lid.
Figure 7D:
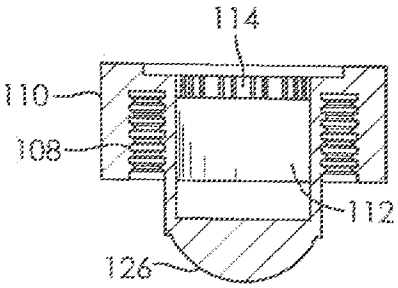
FIG. 7D illustrates the section taken along section A-A of FIG. 7C, detailing the storage portion, in accordance with an embodiment of the present subject matter; the embodiment of FIGS. 7A-7D relates to that of FIGS. 1A and 2A.
Figure 7A:
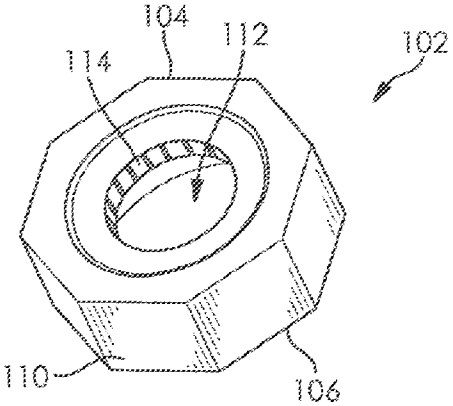
FIG. 7A illustrates a perspective view of one embodiment of a storage portion and one embodiment of a lid.
Figure 7C:
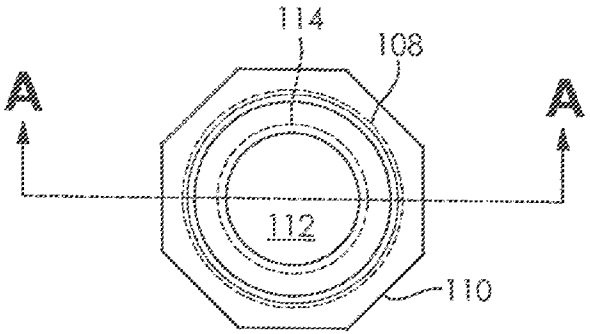
FIG. 7C illustrates a sectioned side view of the storage portion.

Once the pill is pulverized, first spoon 142 slidably moves up longitudinal opening 138 to detach from pill chamber 128. The brace 146 is sized and dimensioned to press against inner chamber sidewall 134 during this slidable movement of first spoon 142. Additionally, the optional pair of slots 150 on the lateral sides of first handle 148 form a snug mating arrangement with tongue 140 on longitudinal opening 138 (FIG. 7A). The relationship between brace 146 and inner chamber sidewall 134, and also the optional pair of slots 150 and tongue 140 helps minimize lateral and oscillating motions by first spoon 142 during movement along the longitudinal opening 138. In some embodiments, second spoon 154 rotatably detaches from the first spoon 142 at the respective fastening junctions 152, 160. Second head 156 may then receive and add a composition, food, or liquid to the pulverized pill for enhancement.

Figure 13:
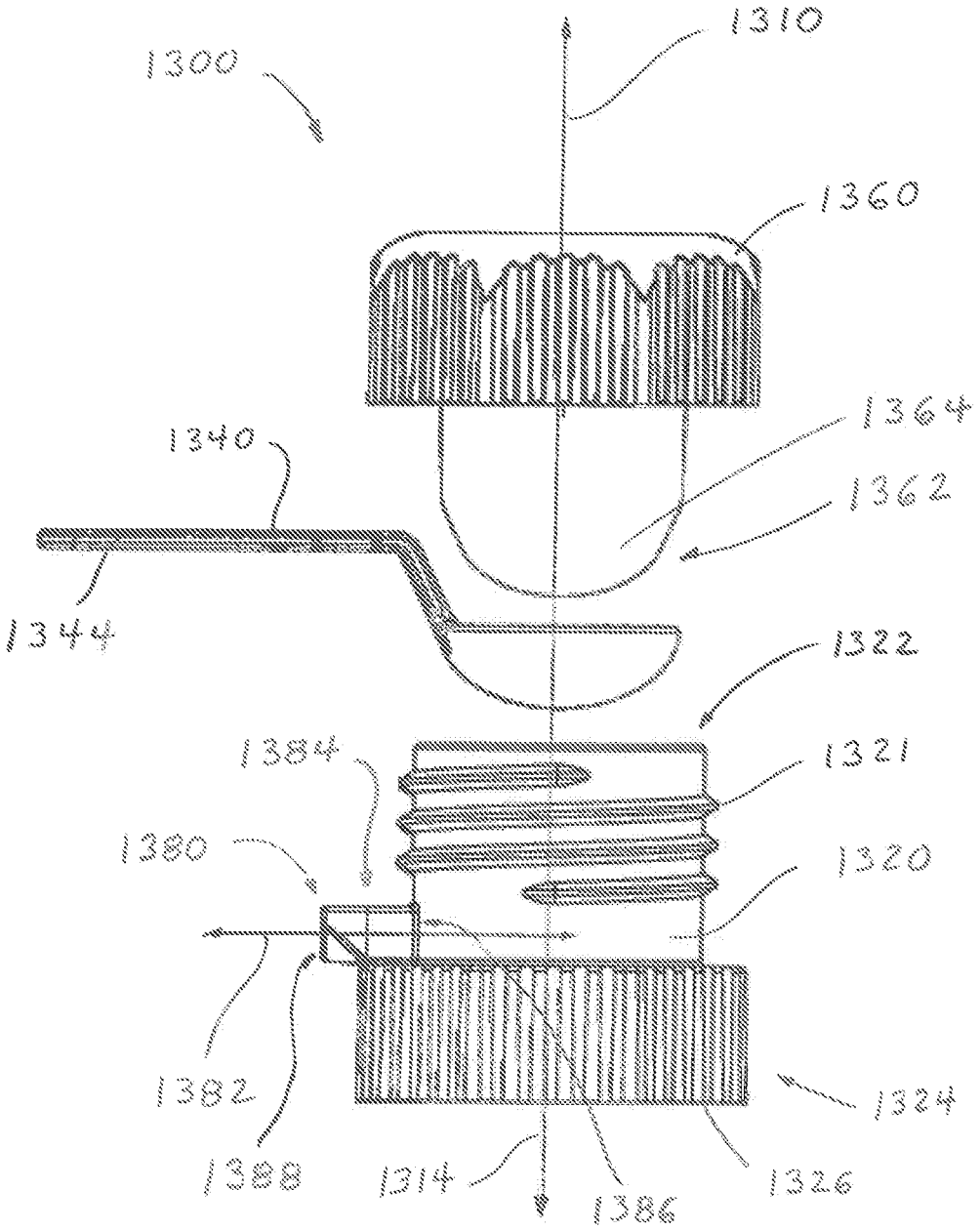
FIG. 13 shows an exploded side view of another exemplary pill crushing device, in accordance with an embodiment of the present subject matter.
Figure 14:
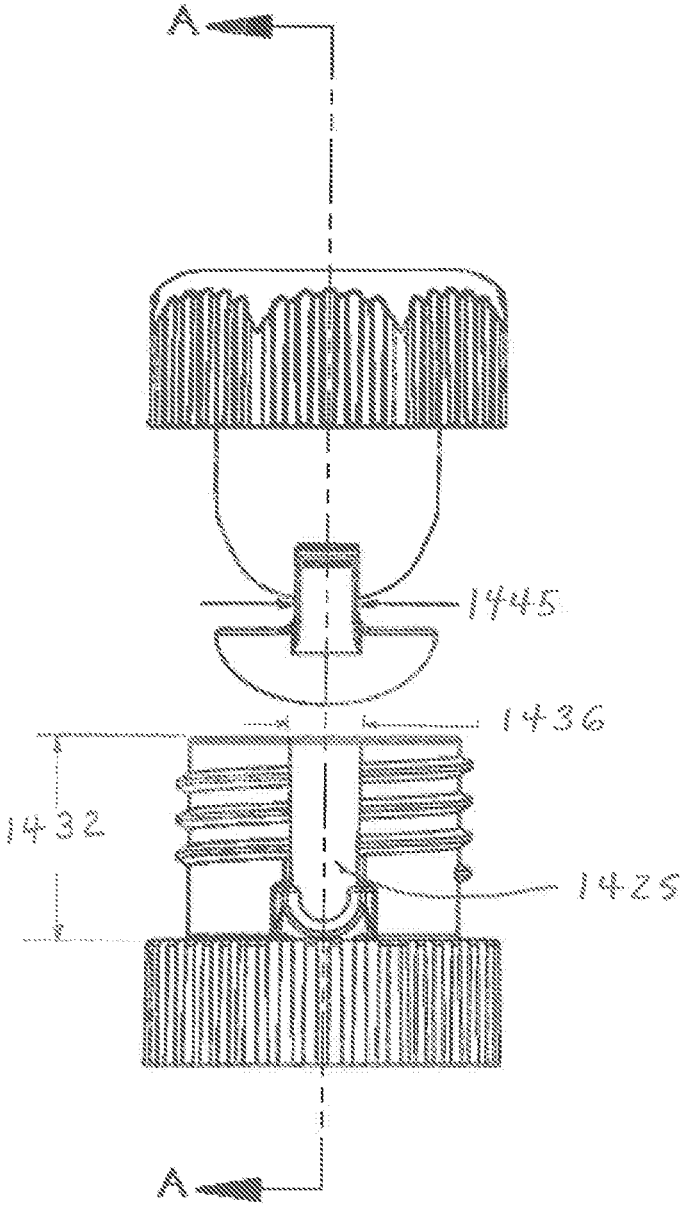
FIG. 14 shows an exploded front sectioned view of the exemplary pill crushing device of FIG. 13, in accordance with an embodiment of the present subject matter.
Figure 15:
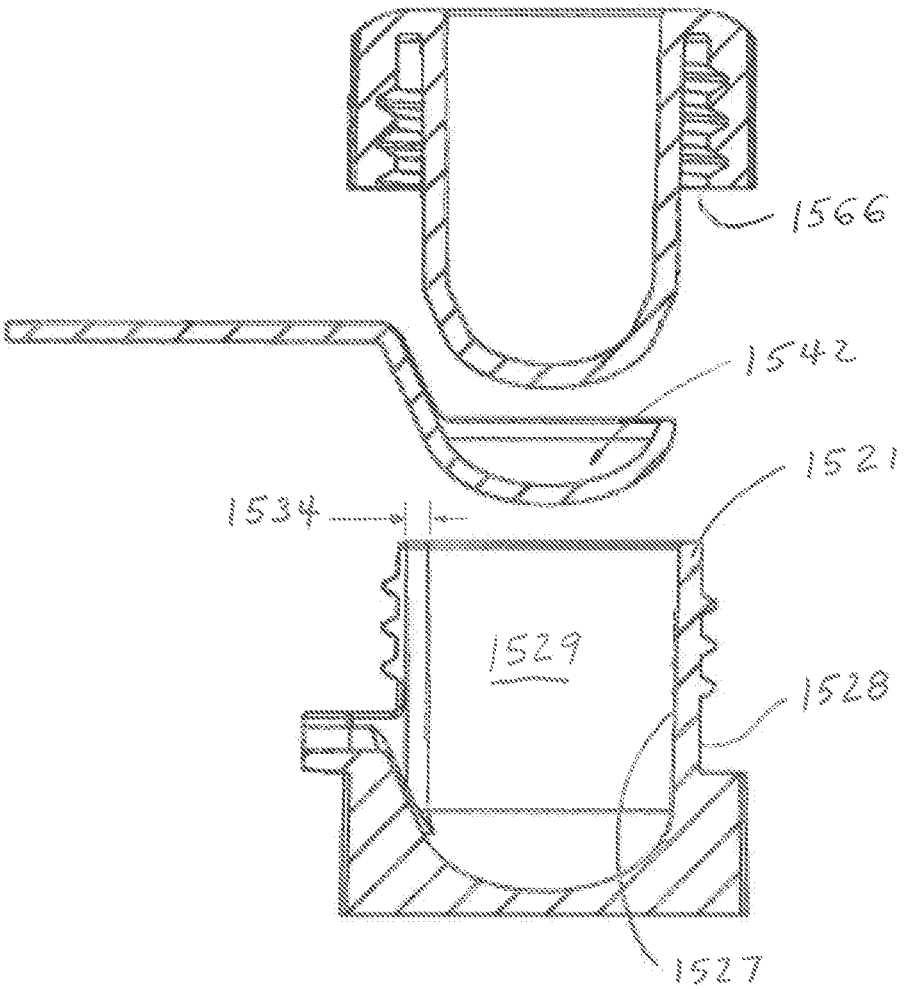
FIG. 15 shows the section taken along section A-A of FIG. 14, detailing the pill crushing device, in accordance with an embodiment of the present subject matter Like reference numerals refer to like parts throughout the various views of the drawings.

Referring now to the embodiment shown in FIGS. 13-15, some non-limiting embodiments of the pill crusher may include an optional spout and may or may not have a storage portion. A pill crushing device 1300 may comprise hollow pill chamber 1320 elongated along a first cylindrical axis 1310, a pill spoon 1340, a crushing portion 1360, and a spout 1380.

The hollow pill chamber 1320 may be cylindrical. The hollow pill chamber 1320 may have a set of ends comprising a top end 1322 and a bottom end 1324 opposite the top end 1322. The top end 1322 may be open. The bottom end 1324 may be closed by a base 1326. The hollow pill chamber 1320 may comprise a cylinder wall 1521 extending between the top end 1322 and the bottom end 1324. The cylinder wall 1521 may have an interior surface 1527 defining an elongated hollow interior region 1529 within the pill chamber 1320. The cylinder wall 1521 may have an exterior surface 1528 opposite the interior surface 1527. The hollow pill chamber 1320 may comprise a first set of threads 1321 having a thread axis 1314 coincident with the first cylindrical axis 1310. The first set of threads 1321 may be engaged with the exterior surface 1528 of the cylinder wall 1521. The hollow pill chamber 1320 may comprise an elongated longitudinal opening 1425. An elongated longitudinal opening 1425 may have a length 1432 extending from the top end of the pill chamber to the bottom end of the pill chamber, a depth 1534 sufficient to define a through hole in the cylinder wall 1521, and a width 1436 sufficient to accommodate the pill spoon 1340 being operationally slid within the elongated longitudinal opening 1425. In some embodiments the width 1436 corresponds to the width 1445 of the handle 1344 of the pill spoon 1340 plus some clearance to provide for a close tolerance clearance fit with the elongated longitudinal opening 1425. In some embodiments, the pill spoon 1340 forms a close sliding fit with the elongated longitudinal opening 1425 but other clearance fits may be chosen with good engineering judgment. The elongated longitudinal opening 1425 may optionally be elongated in a direction parallel to the first cylindrical axis 1310.

The pill spoon 1340 is adapted to slideably and operationally engage with the elongated hollow interior region 1529. In practice, the pill spoon 1340, should be able to nest within the hollow interior region 1529 in a position that permits an associated user to place an associated pill within the concave region 1542 of the spoon for crushing of the associated pill. Further the pill spoon should be able to slide along the first cylindrical axis 1310 for selectable engagement or disengagement with the hollow interior region 1529. In some embodiments, the pill spoon 1340 forms a close sliding fit with the interior surface 1527 defining the elongated hollow interior region 1529 but other clearance fits may be chosen with good engineering judgment. A closer tolerance fit can help prevent spillage of resulting pulverized pill material, but a closer tolerance can also increase cost, so good engineering judgment will inform the proper tolerance for closeness of fit between the pill spoon 1340 and the interior surface 1527 defining the elongated hollow interior region 1529. When in operational engagement with the elongated hollow interior region 1529 of the pill chamber 1320, the handle 1344 of the pill spoon 1340 may extend through the elongated longitudinal opening 1425 of the cylinder wall.

The crushing portion 1360 is adapted to crush an associated pill or pills against the pill spoon 1340 or base 1326. The pill spoon 1340 is configured to operationally engage the elongated hollow interior region 1529 and to receive an associated pill while so engaged. The pill crushing device is also adapted to receive an associated pill in the elongated hollow interior region 1529 and to operate to crush the associated pill in the elongated hollow interior region 1529 without the pill spoon 1340 in the elongated hollow interior region 1529. The crushing portion 1360 crushes associated pills by being threadedly screwed into place against the pill spoon 1340 or base 1326 with an associated pill placed therebetween. The crushing portion 1360 the may be adapted for selectable threaded engagement with the pill chamber 1320. The crushing portion 1360 may comprise a pulverizing end 1362 having a crushing member 1364. In some embodiments the crushing portion 1360 may have a second set of threads 1566 adapted for threaded engagement with the first set of threads 1321. The pulverizing end 1362 may be adapted to advance into the hollow interior region 1529 when the crushing portion 1360 is rotated with respect to pill chamber 1320 to increase threaded engagement with the pill chamber 1320; and withdraw from the hollow interior region 1529 when the crushing portion 1360 is rotated to decrease threaded engagement with the pill chamber 1320. In some embodiments, chirality of the first set of threads 1321 and the second set of threads 1566 is right-handed. In some embodiments, the chirality of the first set of threads 1321 and the second set of threads 1566 is left-handed. The chirality of the threads of the first set of threads 1321 and the second set of threads 1566 may be chosen to tailor the pill crusher to persons who are left-handed or right-handed. This can be of relevance to persons who are infirm, disabled, or who have difficulty applying torque by hand. For example and without limitation, an associated left-handed user might prefer a left-handed threaded pill crusher over that of a right-handed threaded pill crusher for ease of use.

The spout 1380 may be located at where the elongated longitudinal opening 1425 meets the bottom end of the pill chamber 1326. The spout 1380 may extend outwardly along a spout axis 1382 from the exterior surface 1528 of the cylinder wall 1521. The spout may define a top end facing U-shaped recess adapted to support the handle 1344 of the pill spoon 1340. The spout 1380 may be adapted to facilitate the smooth pouring of liquid or pulverized pills from the hollow interior region 1529. Typically a spout 1380 defines an elongated channel 1384 having a first end 1386 opposite a second end 1388 and providing a path corresponding to the channel 1384 between the first end 1386 and second end 1388 adapted for liquid or flowing pulverized material to flow along in a manner that confines the flow to the path such that the flow may be directed from the first end to the second end with little or no spillage.

In operation, the pill crushing device may be used to crush one or more pills in a method wherein the pill crusher is provided; an associated pill is placed in the pill chamber; the pill is crushed between either the crushing member and the spoon, or the crushing member and the base; and the crushed pill is removed from the pill chamber.

The crushed pill may be removed from the pill chamber by a variety of acceptable means. In some methods, the crushed pill may be removed from the pill chamber by sliding the spoon along the first cylindrical axis. In other methods, the crushed pill may be removed from the pill chamber by a method including mixing a liquid with the crushed pill and pouring the resulting mixture out of the elongated hollow interior region along the spout.

Since many modifications, variations, and changes in detail can be made to the described embodiments of the subject matter, it is intended that all matters in the foregoing description and shown in the accompanying drawings be interpreted as illustrative and not in a limiting sense. Thus, the scope of the subject matter should be determined by the appended claims and their legal equivalents.

What is claimed is:

1. A pill crushing device comprising:

a hollow cylindrical pill chamber elongated along a first cylindrical axis, the pill chamber having, a set of ends having a top end, the top end being open, and a bottom end opposite the top end, the bottom end closed by a base, a cylinder wall extending between the top end and the bottom end, the cylinder wall having an interior surface defining an elongated hollow interior region within the pill chamber, the elongated hollow interior region being elongated along the first cylindrical axis, and an exterior surface opposite the interior surface, a first set of threads having a thread axis coincident with the first cylindrical axis, and an elongated longitudinal opening;

a pill spoon slideably and operationally engageable with the elongated hollow interior region such that it is adapted to slide along the first cylindrical axis, the pill spoon having a handle; and a crushing portion adapted for selectable threaded engagement with the cylindrical pill chamber, the crushing portion comprising a pulverizing end having a crushing member; wherein the elongated longitudinal opening has, a length extending from the top end of the pill chamber to the bottom end of the pill chamber, a depth sufficient to define a through hole in the cylinder wall, and a width sufficient to accommodate the pill spoon being operationally slid within the elongated longitudinal opening; and further having, a spout where the elongated longitudinal opening meets the bottom end of the pill chamber, the spout extending outwardly along a spout axis from the exterior surface of the cylinder wall, the spout defining a recess adapted to support the handle of the pill spoon, and facilitate the smooth pouring of liquid or pulverized pills from the elongated hollow interior region.

2. The pill crushing device of claim 1, wherein the pulverizing end is adapted to, advance into the elongated hollow interior region when the crushing portion is rotated to increase threaded engagement with the cylindrical pill chamber; and withdraw from the elongated hollow interior region when the crushing portion is rotated to decrease threaded engagement with the cylindrical pill chamber.

3. The pill crushing device of claim 2, wherein the elongated longitudinal opening is elongated a direction parallel to the first cylindrical axis.

4. The pill crushing device of claim 3, wherein the handle of the pill spoon extends through the elongated longitudinal opening of the cylinder wall when the pill spoon is operationally engaged with the elongated hollow interior region.

5. The pill crushing device of claim 4, wherein the first set of threads is engaged with the exterior surface of the cylinder wall.

6. The pill crushing device of claim 5, wherein the pill spoon has a close sliding fit with the interior surface defining the elongated hollow interior region.

7. The pill crushing device of claim 6, wherein the pill spoon is configured to receive an associated pill while the pill spoon is operationally engaged with the elongated hollow interior region.

8. A method of crushing a pill comprising:

providing a pill crushing device having a hollow cylindrical pill chamber elongated along a first cylindrical axis, the pill chamber having, a set of ends having a top end, the top end being open, and a bottom end opposite the top end, the bottom end closed by a base, a cylinder wall extending between the top end and the bottom end, the cylinder wall having, an interior surface defining an elongated hollow interior region within the pill chamber, the elongated hollow interior region being elongated along the first cylindrical axis, and an exterior surface opposite the interior surface, a first set of threads having a thread axis coincident with the first cylindrical axis, and an elongated longitudinal opening;

a pill spoon slideably and operationally engageable with the elongated hollow interior region such that it is adapted to slide along the first cylindrical axis, the pill spoon having a handle, and a crushing portion adapted for selectable threaded engagement with the cylindrical pill chamber, the crushing portion comprising a pulverizing end having a crushing member, wherein the elongated longitudinal opening has, a length extending from the top end of the pill chamber to the bottom end of the pill chamber, a depth sufficient to define a through hole in the cylinder wall, and a width sufficient to accommodate the pill spoon being operationally slid within the elongated longitudinal opening, and further having, a spout where the elongated longitudinal opening meets the bottom end of the pill chamber, the spout extending outwardly along a spout axis from the exterior surface of the cylinder wall, the spout defining a recess adapted to support the handle of the pill spoon, and facilitate the smooth pouring of liquid or pulverized pills from the elongated hollow interior region;

placing an associated pill in the pill chamber;

crushing the pill between either the crushing member and the pill spoon, or the crushing member and the base; and removing the crushed pill from the pill chamber.

9. The method of crushing a pill of claim 8, wherein the pulverizing end is adapted to, advance into the elongated hollow interior region when the crushing portion is rotated to increase threaded engagement with the cylindrical pill chamber; and withdraw from the elongated hollow interior region when the crushing portion is rotated to decrease threaded engagement with the cylindrical pill chamber.

10. The method of crushing a pill of claim 9, wherein the elongated longitudinal opening is elongated a direction parallel to the first cylindrical axis.

11. The method of crushing a pill of claim 10, wherein the handle of the pill spoon extends through the elongated longitudinal opening of the cylinder wall when the pill spoon is operationally engaged with the elongated hollow interior region.

12. The method of crushing a pill of claim 11, wherein the first set of threads is engaged with the exterior surface of the cylinder wall.

13. The method of crushing a pill of claim 12, wherein the pill spoon has a close sliding fit with the interior surface defining the elongated hollow interior region.

14. The method of crushing a pill of claim 13, wherein the pill spoon is configured to receive a pill while the pill spoon is operationally engaged with the elongated hollow interior region.

* * * * *